United States Patent [19]

Ahlström et al.

[11] Patent Number: 4,738,411

[45] Date of Patent: Apr. 19, 1988

[54] METHOD AND APPARATUS FOR CONTROLLING PASSIVE PROJECTILES

[75] Inventors: Lars G. W. Ahlström; Anders G. Flogvall, both of Järfälla, both of Sweden

[73] Assignee: U.S. Philips Corp., New York, N.Y.

[21] Appl. No.: 490,747

[22] Filed: May 2, 1983

Related U.S. Application Data

[63] Continuation of Ser. No. 222,109, Jan. 2, 1981, abandoned.

[30] Foreign Application Priority Data

Mar. 14, 1980 [SE] Sweden ..... 8002006

[51] Int. Cl.[4] ..... F41G 7/22

[52] U.S. Cl. ..... 244/3.15; 89/1.11

[58] Field of Search ..... 244/3.1, 3.13, 3.15, 244/3.16, 3.19; 89/1.11, 157; 102/211, 213, 214, 374

[56] References Cited

U.S. PATENT DOCUMENTS

| | | | |
|---|---|---|---|
| 2,950,477 | 8/1960 | Alpers | 343/13 |
| 2,987,269 | 6/1961 | Weller | 244/3.13 |
| 3,074,062 | 1/1963 | Alpers | 343/13 |
| 3,116,039 | 12/1963 | Goldberg | 244/3.16 |
| 3,137,850 | 6/1964 | Alpers | 343/13 |
| 3,844,506 | 10/1974 | Stavis et al. | 244/3.15 |
| 3,922,968 | 12/1975 | Conger et al. | 102/214 |
| 3,942,443 | 3/1976 | Lyles | 102/374 |
| 4,004,487 | 1/1977 | Eichweber | 244/3.15 |
| 4,084,480 | 4/1978 | Moscrip | 89/157 |
| 4,214,240 | 7/1980 | Weiss | 102/214 |
| 4,281,809 | 8/1981 | Oglesby et al. | 244/3.16 |

FOREIGN PATENT DOCUMENTS 1419471 12/1975 United Kingdom .

*Primary Examiner*—Charles T. Jordan

*Attorney, Agent, or Firm*—Thomas A. Briody; Jack Oisher; William Streeter

[57] ABSTRACT

A method and a system for controlling explosive projectiles having homing devices or proximity fuses responsive to the reception of electromagnetic energy reflected from a target. The homing devices and the proximity fuses are passive receiving devices, fired along with transmitting projectiles which illuminate the target with electrmagnetic energy.

3 Claims, 2 Drawing Sheets

METHOD AND APPARATUS FOR CONTROLLING PASSIVE PROJECTILES

This is a continuation of application Ser. No. 222,109, filed Jan. 2, 1981, now abandoned.

BACKGROUND OF THE INVENTION

The invention relates to the control of passive explosive projectiles fired at a target. The projectiles are provided with means for automatic guidance toward the target or automatic explosion at a given distance from the target.

Known passive homing devices include homing devices which operate at IR wavelengths. In this case the inherant radiation from the target is detected. Passive systems operating at other wavelengths utilize radiation which is reflected from a target exposed to incident radiation from the environment. However, this results in weak and unreliable guidance information. In order to increase the accuracy of aim for passive homing systems it is known to illuminate a target with electromagnetic energy, for example laser light.

A drawback with conventional illumination techniques is the difficulty in reaching the target with the transmitted illuminating energy. If the transmitter must be situated at a large distance from the target, the effect of the illumination will be poor and the power demand in the transmitter will be high. If the transmitter is placed close to the target and then, as usually is the case, is included in a larger unit, for example in an airplane flying over the target, it will expose itself to counterfire. As a result of this the full range of the projectile can in many cases not be utilized.

SUMMARY OF THE INVENTION

It is an object of the invention to achieve improved aiming accuracy for passive projectiles including homing devices or proximity fuses in a simple and inexpensive manner.

According to the invention this is achieved by firing, along with the passive projectiles, another transmitting projectile which is provided with means for illuminating the target with electromagnetic radiation.

By using two simple projectile types, including a passive projectile and a transmitting projectile having a very small power demand for its transmitter, improved aiming accuracy is achieved without exposing the transmitter. The full range of the explosive projectiles can be utilized and it is possible, in proximity fuse projectiles, to utilize coding in order to improve interference resistance.

If both types of projectiles are directed against the same target, the transmitting projectiles can suitably be adapted to transmit the radiation in a limited lobe, the direction of which substantially coincides with the direction of motion of the projectiles. Thus the risk of self-produced interference in the system will be minimized and the illumination effect will be optimized.

In a first embodiment, the passive receiving projectiles and the transmitting projectiles are fired by the same piece of ordnance, in which case in a burst of fire or in a continuous series of projectiles each $n^{th}$ projectile is a transmitting projectile, where $n>1$. The projectiles of both types will follow the same trajectory and the target will be consistently illuminated by suitable choice of n.

In a second embodiment, the receiving and transmitting projectiles are fired by separate pieces, in which case the firing of projectiles of the receiving type is synchronized with the firing of transmitting projectiles, as that the target will always be illuminated by at least one transmitting projectile for all receiving projectiles which are on their way to the target.

In order to achieve accurate guidance of the homing projectiles, even during low visibility conditions, the transmitters and receivers should operate at a wavelength longer than visible wavelengths, enabling the radiation to penetrate the cause of the low visibility, but not so long that the transmitted energy cannot be directed. A preferred wavelength range is the so called millimeter wavelength range, suitably 3–8 mm.

The invention may, however, be utilized within a very broad frequency band, for example 100 MHz–200 GHz.

BRIEF DESCRIPTION OF THE DRAWING

The invention is illustrated in the accompanying drawing, in which.

DESCRIPTION OF THE PREFERRED EMBODIMENTS

Figure 1:
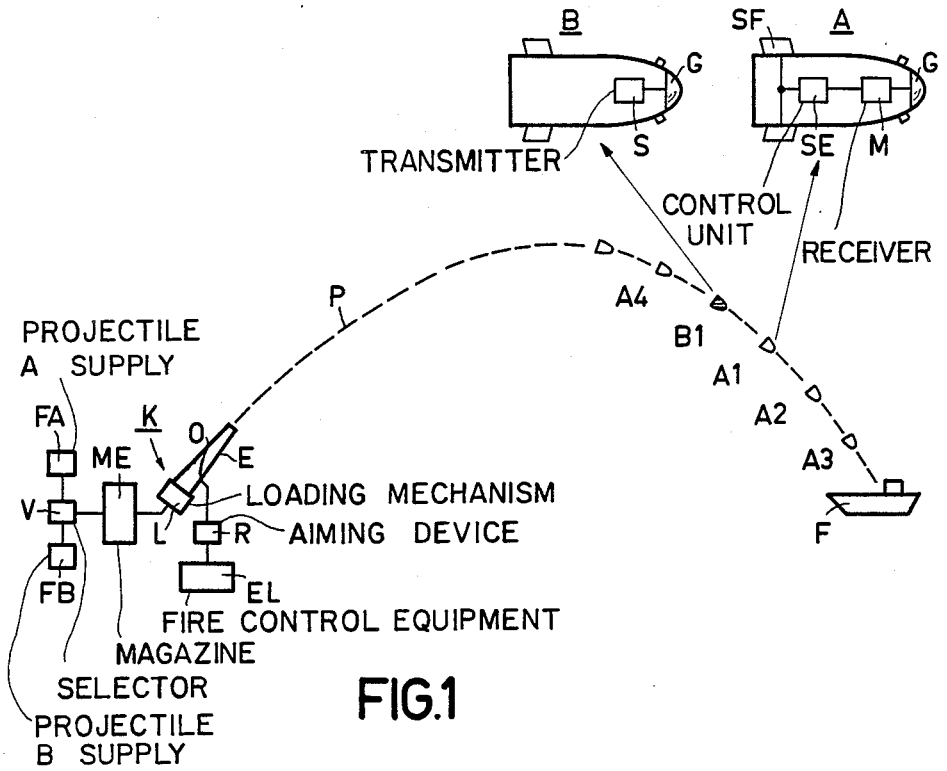
FIG. 1 is a block diagram of a firing system according to the invention where passive homing projectiles and transmitting projectiles are fired by the same piece of ordnance.

In FIG. 1 reference letter K designates a piece of ordnance comprising a firing tube E, R is an aiming device for positioning the firing tube E by swinging horizontally about an axis 0 and vertically about an axis (not shown), EL is a fire control equipment, L is a loading mechanism and ME is a magazine for projectiles. The fire control equipment EL determines by means of signals from measuring transducers (not shown) the position of a selected target F, a ship, and delivers control signals to the device R which as a result of this aims the firing tube E so that the projectiles theoretically will follow a trajectory P and hit the target. During firing the projectiles are fed in rapid succession from the magazine ME to the loading mechanism L and are fired at the same rate so that due to the large distance between the piece of ordnance and the target, often several kilometers, a large number of projectiles are simultaneously in the air and on their way to the target.

According to the invention the magazine ME is filled with two different kinds of projectiles which can be designated A and B, A being an explosive projectile provided with a passive or purely receiving homing device, while B is a purely transmitting projectile. The projectile B may be explosive or not. The projectiles A and B are fed into the magazine ME from a projectile supply FA for the projectiles A and a projectile FB for the projectiles B via a selector V. This selector is so constructed that each $n^{th}$ projectile in the magazine comes from FB while the remaining projectiles will come from the supply FA, n being larger than 1, suitably 3–5. In the example n is equal to 4 which means that each fourth projectile in the air is a projectile B, while the three intermediate projectiles are of A-type.

The selector V may in practice be realized as a purely manual operation.

As can be seen from the detail drawing at the top right of FIG. 1, the projectile A has a receiver M which receives radiation via a dome shaped antenna G and delivers its output signal to a control unit or servo mechanism SE. This mechanism generates an error signal representing the deviation of the trajectory of the projectile from the trajectory through the target, which error signal for example is adapted to influence steering wings SF in such manner that the error signal is regulated to zero. The receiver M may in usual manner operate according to the scanning principle or with multi lobes. The total sensitivity lobe is limited and has for example an order of magnitude of 20°. The projectile B has only a transmitter S delivering its signal to a dome shaped antenna G. This antenna transmits electromagnetic energy in a limited lobe of approximately 20° in the motion direction of the projectile. As a result of the directed radiation the transmitter power can be relatively small, for example 1 W, and the transmitter S is suitably of solid-state type. The wavelength is in a preferred example 3 mm or 7.5 mm.

In operation, a projectile of the B-type, such as $B_1$ in FIG. 1, at least during the last part of its travel, illuminates the target F with electromagnetic energy. The target reflects the energy which is received by the receivers in the projectiles of the A-type, which projectiles are thus guided to the target by means of energy transmitted from the B-projectile. A transmitting projectile thus assists the projectiles in front of it in the trajectory, such as the projectiles $A_1$, $A_2$ and $A_3$ in FIG. 1, which are in the final phase of the homing action, but also one or more projectiles situated behind it, such as the projectile $A_4$ in FIG. 1, which is just starting the correction of its trajectory in order to hit the target F.

Figure 2:
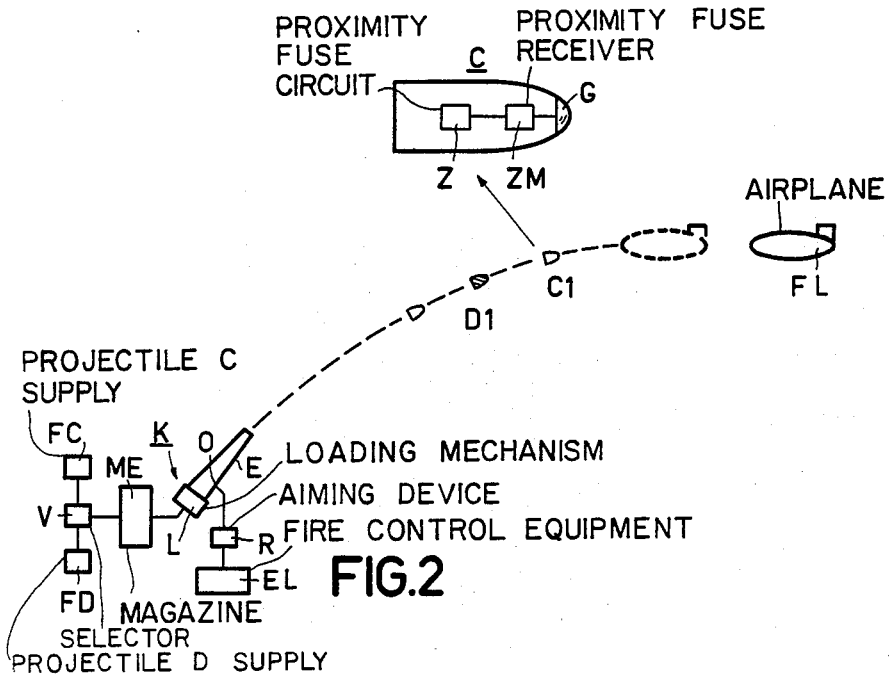
FIG. 2 is the corresponding block diagram of a firing system for proximity fuse projectiles.

FIG. 2 shows an embodiment of the invention utilizing proximity fuse projectiles. In FIG. 2 the firing system is the same as that in FIG. 1 except that the supplies for the projectiles are designated FC and FD, respectively, and contain projectiles C of proximity fuse type and projectiles D which as in the foregoing example are purely transmitting projectiles. According to the detail drawing at the top of FIG. 2, the projectile C contains a proximity fuse receiver ZM adapted to receive radiation via an antenna G. The proximity fuse receiver ZM, which for example operates according to the Doppler effect, delivers its output signal to a proximity fuse circuit Z having an electric ignitor for detonating the projectile at a given distance from the target, which in this case is represented by an airplane FL. The proximity fuse is in this case passive, i.e. purely receiving. In operation a projectile of the D-type, such as $D_1$ in FIG. 2, illuminates the target which reflects the energy back to the projectile $C_1$ situated in from of $D_1$. Each transmitter assists only one or more projectiles situated in front of it, because the projectiles situated behind it are still at too large a distance from the target. n may in this case be selected equal to 2 or 3, for example, such that each second or each third projectile is transmitting while the intermediate projectiles are receiving, i.e. the passive, proximity fuse type.

In order to increase interference resistance, the transmitters and receivers may in the proximity fuse case be so constructed that they operate according to a given identification code.

In both cases the transmitters and receivers operate with strongly directed radiation in the direction of motion of the projectiles.

Figure 3:
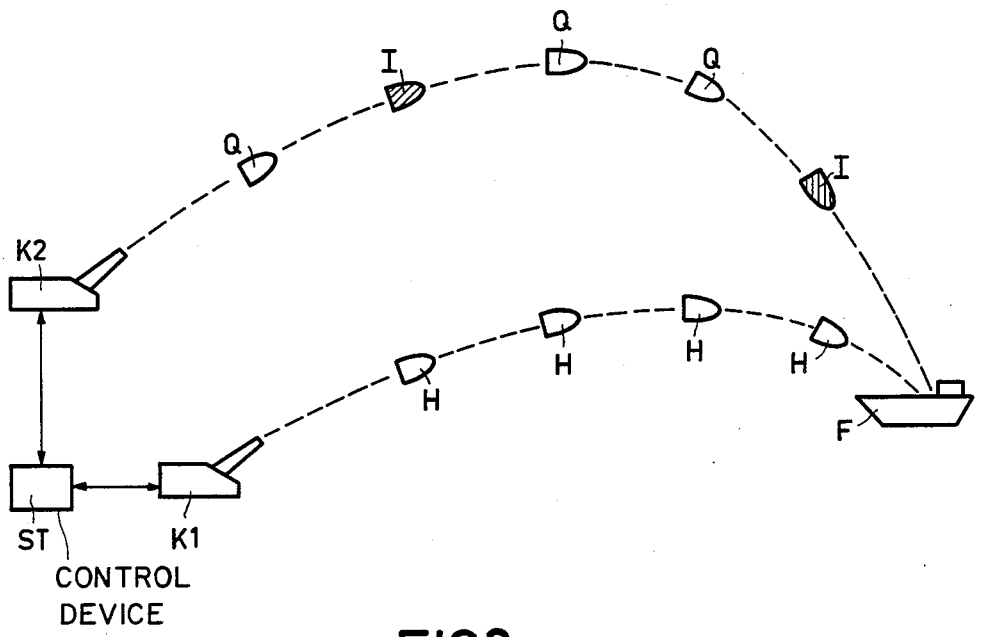
FIG. 3 illustrates a system in which the transmitting and receiving projectiles are fired by different pieces.

FIG. 3 illustrates the case where the passive or receiving projectiles and the transmitting projectiles, are fired with different pieces of ordnance. In the figure, K1 designates a piece which only fires explosive projectiles H comprising passive homing devices of electromagnetic type. Alternatively the projectiles H may be provided with passive proximity fuses which operate by receiving electromagnetic radiation. K2 is a second piece of ordnance which is situated at a distance from K1 and which, at regular intervals, fires projectiles I similar to the projectiles B and D in FIGS. 1 and 2, which projectiles I are provided with transmitting means for transmitting of electromagnetic radiation. The projectiles I may be explosive or not. Between two successive projectiles I the piece K2 fires a number of projectiles Q which can be either conventional explosive projectiles or projectiles provided with passive homing devices or proximity fuses. Both pieces K1, K2 are aimed at the same target F and are controlled by a common control device ST. This control device ST is constructed such that it synchronizes the firing of each projectile I with the firing of projectiles H. At the beginning of a firing burst, the control device ST ensures that the first projectile H in the burst always is accompanied by a projectile I which illuminates the target when the first projectile H is moving toward the target F and, for example, reaches the target approximately simultaneously with H. In the case of rapid and continuous firing from both K1 and K2, where projectiles I are fired at close intervals, exact synchronization is not necessary. Alternatively the firing of each projectile I can be synchronized with the firing of certain ones of the projectiles H, so that each projectile I is associated with given projectiles H and provides illumination means for them.

What is claimed is:

1. A system for controlling a predetermined offensive operation of a projectile fired against a target, comprising:

(a) at least one transmitting projectile having means for illuminating the target by transmitting electromagnetic radiation toward the target while said transmitting projectile moves along a trajectory;

(b) at least one receiving projectile having means for receiving transmitted radiation reflected by the target and means for performing said predefined offensive operation in response to said reflected radiation while said receiving projectile moves along a trajectory; and (c) firing means for firing said projectiles into respective trajectories ending at the target, said projectiles being fired with sufficient regularity to ensure that the target is illuminated by at least one transmitting projectile whenever a receiving projectile is within receiving range of transmitted radiation reflected by the target;

(d) said firing means comprising a single firing device and a feeding means for successively feeding transmitting and receiving projectiles to said device in a predefined sequence.

2. A system as in claim 1 where the transmitted radiation has a wavelength in the range of approximately 3–8 mm.

3. A system as in claim 2 where the transmitting projectile includes an antenna adapted for transmitting the illuminating electromagnetic radiation in the form of a lobe having a maximum beam width of 30°, said lobe being oriented in the general direction of motion of said transmitting projectile.

* * * * *